US006426137B1

(12) United States Patent
Oshika et al.

(10) Patent No.: US 6,426,137 B1
(45) Date of Patent: Jul. 30, 2002

(54) COATED CEMENTED CARBIDE CUTTING TOOL MEMBER

(75) Inventors: Takatoshi Oshika; Tetsuhiko Honma; Toshiaki Ueda; Eiji Nakamura, all of Omiya (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/548,675

(22) Filed: Apr. 13, 2000

(30) Foreign Application Priority Data

| | | |
|---|---|---|
| Apr. 13, 1999 | (JP) | 11-104941 |
| Jun. 23, 1999 | (JP) | 11-176146 |
| Jul. 1, 1999 | (JP) | 11-187780 |
| Aug. 12, 1999 | (JP) | 11-228305 |
| Aug. 12, 1999 | (JP) | 11-228307 |
| Aug. 13, 1999 | (JP) | 11-229301 |
| Aug. 13, 1999 | (JP) | 11-229302 |
| Oct. 15, 1999 | (JP) | 11-293093 |
| Dec. 22, 1999 | (JP) | 11-363922 |
| Dec. 22, 1999 | (JP) | 11-363925 |
| Feb. 21, 2000 | (JP) | 2000-042178 |
| Feb. 21, 2000 | (JP) | 2000-042181 |

(51) Int. Cl.[7] ..... B32B 15/04

(52) U.S. Cl. ..... 428/336; 407/119; 428/697; 428/698; 428/699; 428/701; 428/702

(58) Field of Search ..... 428/701, 702, 428/698, 336, 216, 697, 699; 407/119

(56) References Cited

U.S. PATENT DOCUMENTS

| | | | | | |
|---|---|---|---|---|---|
| 4,463,026 | A | * | 7/1984 | Hale | 428/698 |
| 4,812,370 | A | * | 3/1989 | Okada et al. | 428/552 |
| 6,071,601 | A | * | 6/2000 | Oshika et al. | 428/216 |

* cited by examiner

*Primary Examiner*—Archene Turner
(74) *Attorney, Agent, or Firm*—Oblon, Spivak, McClelland, Maier & Neustadt, P.C.

(57) ABSTRACT

A coated cemented carbide cutting member for a cutting tool comprising a substrate and a hard coating layer on said substrate, wherein the hard coating layer comprises at least one layer selected from the group consisting of titanium carbide, titanium nitride, titanium cabonitride, titanium carboxide, titanium carbonitroxide, aluminum oxide, and aluminum oxide-zirconium oxide composite in which zirconium oxide phases are dispersed around ground aluminum oxide phases, and wherein the hard coating layer is provided with an outer layer which comprises titanium oxide which is expressed by the molecular formula $TiO_w$, wherein w is the atomic ratio of oxygen to titanium which ranges from 1.20 to 1.90.

20 Claims, 3 Drawing Sheets

COATED CEMENTED CARBIDE CUTTING TOOL MEMBER

BACKGROUND OF THE INVENTION

1. Field of the Invention

The present invention relates to a coated cemented carbide cutting tool member (hereinafter referred as "coated carbide member") that resists breakage and chipping of its cutting edge for a long period of time during high speed cutting operations not only of usual steel and cast iron but also of difficult-to-machine materials such as stainless steel because of its excellent surface lubricity against work chips.

2. Description of the Background

Coated carbide members are preferably composed of a tungsten carbide-based cemented carbide substrate and a hard coating layer preferably comprising a titanium compound layer including at least one layer of titanium carbide (hereinafter referred to as "TiC"), titanium nitride (TiN), titanium carbonitride (TiCN), titanium carboxide (TiCO) and titanium carbonitroxide (TiCNO), and an aluminum oxide ($Al_2O_3$) layer and/or aluminum oxide-zirconium oxide composite layer ($Al_2O_3$—$ZrO_2$ composite), in which layer zirconium oxide phases are dispersed in the $Al_2O_3$ phase as disclosed in Japanese Unexamined Patent Publication No. 57-39168 and No. 61-201778. The hard coating layer is formed preferably by means of chemical vapor deposition and/or physical vapor deposition and has an average thickness of 3 to 30 $\mu$m. A coated carbide member having a hard coating layer, wherein the first layer is TiN, the second layer is TiCN, the third layer is TiCNO, the fourth layer is $Al_2O_3$ and the fifth layer is TiN, is disclosed in Japanese Unexamined Patent Publication No. 7-328810. These coated carbide members are widely used in various fields of cutting operations, for example, the continuous and interrupted cutting of metal work pieces such as steel and cast iron.

It is well-known that titanium compound layers have a granular crystal morphology and are used in many applications. TiC layers have been used as highly abrasion resistant materials in many applications. TiN layers have been used in various fields such as surface decorative coating because of the beautiful external gold-like appearance of TiN layers. It is known that outermost layer(s) of the hard coating layer of many kinds of coated carbide member are made of TiN because of its nice appearance. In fact, this distinctive appearance makes it possible for machine operators to identify new cutting edges from the cutting edges which are worn. A TiCN layer that has a longitudinal crystal morphology, which is produced by chemical vapor deposition at a moderate temperature range such as 700~950° C. using reaction gas mixture which includes organic cyanide compounds such as acetonitrile ($CH_3CN$), has been known as a highly wear resistant coating layer. This layer was disclosed in Japanese Unexamined Patent Publications Nos. 6-8010 and No. 7-328808.

$Al_2O_3$ layer have several different crystal polymorphs, among which alpha-$Al_2O_3$ is known as the thermodynamically most stable polymorph, which has a corundum structure. Typical polymorphs of the $Al_2O_3$ layer formed by the usual CVD conditions are stable alpha-$Al_2O_3$, meta-stable kappa-$Al_2O_3$ and amorphous $Al_2O_3$. For these $Al_2O_3$ layers, crystallographic investigations are widely performed using an X-ray diffraction system which emits Cu K $\alpha$-radiation having a wavelength of about 1.5 Å. With regard to the alpha-$Al_2O_3$ layer, different types of alpha-$Al_2O_3$ layers can be formed depending upon the manufacturing conditions employed. These individual alpha-$Al_2O_3$ layers have different X-ray diffraction patterns. They have maximum peak intensities at different positions, at any of $2\theta$=25.6 degrees (its preferred growth orientation is in 012 direction), 35.1 degrees (104 direction), 37.8 degrees (110 direction), 43.4 degrees (113 direction), 52.6 degrees (024 direction), 57.5 degrees (116 direction), 66.5 degrees (124 direction) and 68.2 degrees (030 direction). Also for kappa-$Al_2O_3$ layers, different types of kappa-$Al_2O_3$ layers can be formed depending on the manufacturing conditions employed. They have maximum peak intensities at different positions, at any of $2\theta$=19.7 degrees, 29.4 degrees, 32.1 degrees, 34.9 degrees, 37.3 degrees, 43.9 degrees, 52.6 degrees, 56.0 degrees, 62.3 degrees and 65.2 degrees.

In recent years, there has been an increasing demand for labor saving, less time consuming cutting operations. Accordingly, there is a tendency to require cutting tools which can be generally used in various cutting operations of different work materials. Further, the conditions of these cutting operations have changed to high-speed cutting operations. For coated carbide members, although there are few problems when they are applied in the continuous or interrupted cutting of alloyed steel or cast iron under common cutting conditions, there are severe problems when they are applied to extremely viscous work materials such as stainless steel or mild iron. Because the chips of these materials generated by the cutting operation have high affinity to conventional $Al_2O_3$ layers and Ti compound layers, which comprise a hard coating layer, the work chips are likely to smear tightly against the surface of the cutting edge. These phenomena become more evident at increased cutting speeds and induce the breakage or chipping of the body at its cutting edge with the consequence that the tool lifetime become shorter. A need, therefore, continues to exist for coated carbide members which resist chipping during high speed cutting operations over long periods of time.

SUMMARY OF THE INVENTION

Accordingly, one object of the present invention is to provide a coated carbide member which resists breakage or chipping of its cutting edge over long periods of time during high speed cutting operations, not only of the usual steels and cast irons, but also of hard-machining materials such as stainless steel and mild steel.

Briefly, this object and other objects of the present invention as hereinafter will become more readily apparent can be attained by a coated cemented carbide cutting member for a cutting tool comprising a substrate and a hard coating layer on said substrate, wherein the hard coating layer comprises at least one layer selected from the group consisting of titanium carbide, titanium nitride, titanium cabonitride, titanium carboxide, titanium carbonitroxide, aluminum oxide, and aluminum oxide-zirconium oxide composite in which zirconium oxide phases are dispersed around ground aluminum oxide phases, and wherein the hard coating layer is provided with an outer layer which comprises titanium oxide which is expressed by the molecular formula $TiO_w$, wherein w is the atomic ratio of oxygen to titanium which ranges from 1.20 to 1.90. The outermost layer has an attractive external appearance and also exhibits excellent surface lubricity against work chips. This coated carbide member provides good wear resistance and long tool lifetime even when used in high speed cutting operations of viscous materials such as stainless steel and mild steel.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
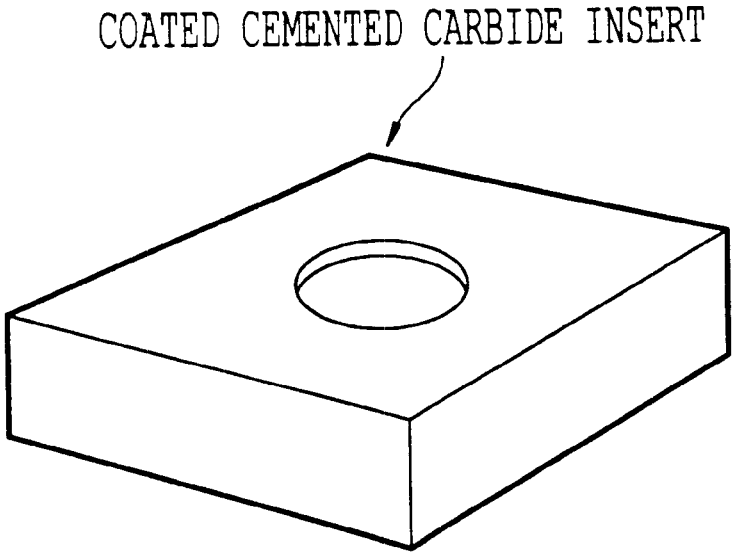
FIG. 1 is an outline sketch of a coated cemented carbide insert (a), and a cross-sectional image of the insert (b)

The present invention provides a hard coating layer which is coated on the cutting member of a cutting tool. The term "cutting member" refers to the part of the cutting tool that actually cuts the work piece. Cutting members include exchangeable cutting inserts which are mounted on the bit holders of turning tools, face milling cutter bodies, and end-milling cutter bodies. Cutting members also include the cutting blades of drills and end-mills. The cutting member is preferably made of tungsten carbide-based cemented carbide substrates.

The hard coating layer preferably coats a portion of the surface, more preferably the entire surface of the cutting member. The hard coating layer is preferably made of a titanium compound layer which is composed of at least one layer selected from the group consisting of TiC, TiN, TiCN, TiCO and TiCNO, an $Al_2O_3$ layer and/or $Al_2O_3$—$ZrO_2$ composite layer and an outer layer preferably comprising titanium oxide that has a composition of the formula $TiO_w$, wherein w expresses the atomic ratio of oxygen relative to titanium, and ranges from 1.25 and 1.90. A TiN layer, which has a beautiful appearance, may also be used as a coating as the outermost layer on said outer layer, wherein the outermost TiN layer actually changes into a titanium nitroxide layer that has a composition of the formula $TiN_{1-y}(O)_y$, wherein (O) expresses the diffused oxygen from beneath the titanium oxide layer, and ranges from 0.01 to 0.40. The outer layer or outermost layer exhibits the superior characteristic of surface lubricity against work chips, which means that work chip smearing against cutting edges hardly occurs, even if the coated carbide member is used for cutting operations of extremely viscous work materials such as stainless steel and mild steel.

The preferred embodiments of the present invention were discovered after testing many different kinds of hard coating layers on cemented carbide cutting member from the standpoint of developing a new long lifetime coated carbide member to which work chips hardly smear even when the cutting member is applied to high speed cutting operations of viscous materials. From these tests, the following results (A) through (F) were found:

(A) According to U.S. Pat. No. 4,442,169, a titanium oxide layer ($TiO_2$) can be produced by means of chemical vapor deposition from a reaction mixture of $TiCl_4$, $CO_2$ and $H_2$. Further, according to European Patent Application 0878,563, a titanium oxide based layer comprising $Ti_2O_3$ having a corundum phase and TiCNO having a cubic phase can be produced by means of chemical vapor deposition using a reaction gas mixture of $TiCl_4$, $CO_2$, $N_2$ and $H_2$. But, with regard its usage as a surface layer of a coated carbide member, the surface smoothness of these conventional titanium oxide layers is not sufficient, wherein built-up edges, which induce relative shorter tool lifetimes than expected, sometimes occur on the cutting edge because of the smearing of work chips thereon.

(B) A titanium oxide layer, which has a very smooth surface and can be expressed as molecular formula $TiO_w$, wherein w is the atomic ratio of oxygen to titanium and ranges from 1.25 to 1.90, can be manufactured by means of chemical vapor deposition using a reactive gas mixture containing a fairly significant amount of inert gas, preferably containing 0.2 to 10 percent by volume (hereinafter merely percent) of $TiCl_4$, 0.1 to 10 percent of carbon dioxide ($CO_2$), 5 to 60 percent of argon (Ar), and the remaining balance being hydrogen ($H_2$) at a temperature of 800 to 1100° C. and a pressure of 30 to 500 Torr. The atomic ratio w can be confirmed by measurement using Auger Electron Spectroscopy (hereinafter referred to as "AES") by irradiating the center of the layer of the cross-sectional polished surface of the hard coating layer with an electron beam.

(C) When the titanium oxide layer is deposited as an outer layer on the conventional coated carbide member, the resulting tool gives fairly long tool lifetimes without any work chip smearing, breakage and chipping on the cutting edge, even when it applied to high speed cutting operations of difficult-to-machine materials such as stainless steel and mild steel, because of the extremely low affinity of the outer titanium oxide layer to these work materials and the superior surface flatness and lubricity of the layer.

(D) During the deposition of the TiN layer as an outermost layer on the coated carbide member which has the outer titanium oxide layer, by means of chemical vapor deposition using a conventional reactive gas mixture for TiN, preferably containing 0.2 to 10 percent of $TiCl_4$, 4 to 60 percent of nitrogen ($N_2$), and the remainder being $H_2$ at a temperature of 800 to 1100° C. and a pressure of 30 to 650 Torr, some of the oxygen beneath the titanium oxide layer diffuses into the growing outermost TiN layer. Consequently, a titanium nitroxide layer containing diffused oxygen is formed. After depositing the outermost titanium nitroxide layer, the w value of the outer layer, $TiO_w$, decreases from 1.25~1.90 to 1.20~1.70. Meanwhile, the atomic ratio of the diffused oxygen to titanium of the outermost titanium nitroxide layer becomes such as to range from 0.01 and 0.40. This layer is expressed as molecular formula $TiN_{1-y}(O)_y$, wherein (O) expresses diffused oxygen from beneath the titanium oxide layer and y expresses the atomic ratio of diffused oxygen to titanium. In this case, the resulting tool also gives fairly long tool lifetimes without any work chip smearing, breakage and chipping at the cutting edge, even when it is applied to high speed cutting operations of difficult-to machine materials such as stainless steel and mild steel, because of its extremely low affinity toward these work materials and the superior surface lubricity of the outermost titanium nitroxide layer. Further, the outermost titanium nitroxide layer, which involves diffused oxygen, has a very visually appealing golden external color like a conventional TiN layer. It also makes it easier for the machine operator to identify the new cutting edges from already worn cutting edges.

(E) Instead of coating said outermost TiN layer on said titanium oxide layer, the coating of either a TiC or a TiCN layer also gives the same effects including superior surface lubricity.

(F) In the case the outer titanium oxide layer is deposited on the surface of either the $Al_2O_3$ layer or the $Al_2O_3$—$ZrO_2$ composite layer, interfacial adherence between the titanium oxide layer and the $Al_2O_3$ layer or the $Al_2O_3$—$ZrO_2$ composite layer can be further strengthened by keeping this coated carbide member in a gas environment comprising 0.05 to 10 percent of $TiCl_4$, with the remainder being an inert gas such as Ar at a temperature of 800 to 1100° C. and a pressure of 30 to 650 Torr for a prescribed duration, for example, 5 minutes to 5 hours. This treatment forms a diffusion zone around the interface of the titanium oxide layer and the $Al_2O_3$ layer or the $Al_2O_3$—$ZrO_2$ composite layer. The thickness of this zone preferably ranges from 0.05 to 2 μm. This treatment is particularly effective when the w value is rather low, for example, within the limits ranging from 1.25 to 1.40, or the thickness of the outer titanium oxide layer is rather thin, for example, within the limits ranging from 0.1 to 1 μm.

Based on these results, the present invention provides for a coated carbide member that exhibits superior resistance against breakage and chipping of a cutting edge for a long period of time during high speed cutting operations, not only of the usual steels and cast iron, but also of difficult-to-machine materials such as stainless steel and mild steel, because of its excellent surface lubricity against work chips and surface smoothness, by providing a coated carbide member preferably composed of a cemented carbide substrate and a hard coating layer preferably having an average thickness of 3 to 30 μm formed on the substrate which is formed of at least one layer selected from the group consisting of TiC, TiN, TiCN, TiCO and TiCNO, and the $Al_2O_3$ layer and/or the $Al_2O_3$—$ZrO_2$ composite layer, wherein the hard coating layer further has an outer titanium oxide layer having an average thickness of 0.1 to 3 μm and which can be expressed as $TiO_w$, wherein w is the atomic ratio of oxygen to titanium which ranges from 1.25 to 1.90 by AES determination.

The present invention also provides a coated carbide member that exhibits superior resistance against breakage and chipping of cutting edges over long periods of time during high speed cutting operations of difficult-to-machine materials such as stainless steel and mild steel, by providing a coated carbide member which further has an outermost titanium nitroxide layer, having an average thickness of 0.05 to 2 μm and which can be expressed as $TiN_{1-y}(O)_y$, wherein (O) is diffused oxygen and y is the atomic ratio of diffused oxygen yo titanium which ranges from 0.01 to 0.40 by AES determination, on the outer titanium oxide layer.

In the present invention, the average thickness of the hard coating layer is preferably 3 to 30 μm. Excellent wear resistance cannot be achieved at a thickness of less than 3 μm, whereas breakage and chipping at the cutting edge of the cutting member easily occur at a thickness of over 30 μm.

The average thickness of the outer layer is preferably 0.1 to 3 μm. Satisfactory surface lubricity and sufficient oxygen supply to the outermost layer cannot be achieved at a thickness less than 0.1 μm, whereas these characteristics are always sufficient at 3 μm.

The average thickness of the outermost layer is preferably 0.05 to 2 μm. Satisfactory surface appearance and good surface lubricity cannot be secured at a thickness less than 0.05 μm, whereas the external appearance and surface lubricity are sufficient at 2 μm.

With regard to the outermost titanium nitroxide layer, the atomic ratio of diffused oxygen to titanium, which is the y value, is preferably 0.01 to 0.40. Satisfactory surface lubricity cannot be achieved when y is less than 0.01, meanwhile some pores are likely to form beneath the titanium oxide layer and consequently formation of a sound layer cannot be achieved when y is more than 0.40. This outermost layer can be formed when a TiN layer is deposited on the titanium oxide outer layer, whose atomic ratio of oxygen to titanium, which is the w value, ranges from 1.25 and 1.90. In the mechanism of the formation of the titanium nitroxide layer, it is obvious that diffusion of oxygen from beneath the titanium oxide layer is indispensable. In the event the value of w is less than 1.25, it becomes difficult to obtain an outermost titanium nitroxide layer which has a sufficient amount of diffused oxygen. On the other hand, if the value of w is more than 1.90, too much oxygen diffuses into the outermost layer when the y value is more than 0.40. So, the value of w is limited to the range of 1.25 to 1.90.

Having generally described this invention, a further understanding can be obtained by reference to certain specific Examples that are provided herein for purposes of illustration only and are not intended to be limiting unless otherwise specified.

EXAMPLES

Example 1

Figure 1B:
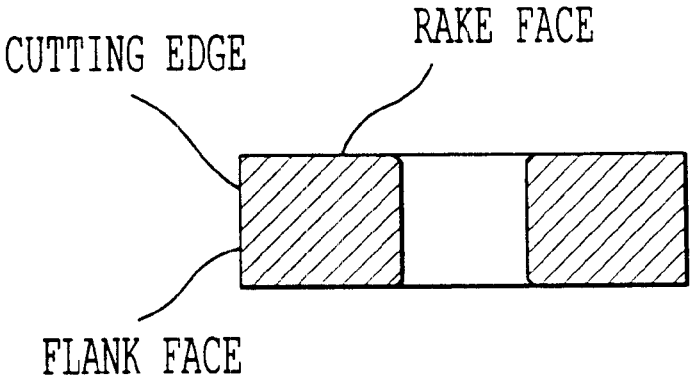

The following powdered materials whose average grain sizes are in the range of 0.5 to 4 μm were prepared as raw materials for substrates: a WC powder, a TiC/WC powder (TiC/WC=30/70 by weight), a (Ti,W)CN powder (TiC/TiN/WC=24/20/56), a TaC/NbC powder (TaC/NbC=90/10), $Cr_3C_2$ powder and Co powder. These powders were compounded based on the formulation shown in Table 1, wet-mixed in a ball mill for 72 hours and dried. Several dry powder mixtures were prepared in this manner and then each was pressed at a pressure of 1 ton/cm$^2$ to form green compacts, which were sintered under the following conditions; pressure: 0.01 to 0.05 Torr, temperature: 1300 to 1500° C., holding duration: 1 hour, to manufacture cemented carbide insert substrates A through F defined in ISO-CNMG 120408, whose shape is shown in FIG. 1.

The cutting edges of the cemented carbide insert substrates A through F were honed. Each substrate was subjected to chemical vapor deposition using conventional equipment under the conditions shown in Tables 2 and 3 to provide hard coating layers on the substrate. 1-TiCN in Table 2 represents the TiCN layer that had a crystal morphology longitudinally grown as described in Japanese Unexamined Patent Publication No. 6-8010. Target diffraction angles for both alpha-$Al_2O_3$ and kappa-$Al_2O_3$ in Table 2 express the diffraction angle (2θ) which has the maximum peak intensity among all peaks belonging to $Al_2O_3$ in X-ray diffraction patterns. To manufacture coated cemented carbide inserts in accordance with the present invention, a hard coating layer comprising a titanium compound layer, an $Al_2O_3$ layer and an outer titanium oxide layer was coated on each substrate, wherein the designed coating layer structure and thickness of each layer is shown in Table 4. In order to manufacture conventional coated cemented carbide inserts, the same substrates and coating layer structures, but outer titanium oxide layers compared to the present invention were applied, wherein the designed coating layer structure and thickness of each layer is shown in Table 5. Coated cemented carbide inserts in accordance with the present invention 1 through 14 and conventional coated carbide inserts I through 14 were manufactured in such a manner.

For coated cemented carbide inserts of present invention 1 and 3, treatment to improve interfacial adherence between the $Al_2O_3$ layer and the outer titanium oxide layer was applied after said titanium oxide layer was coated. For present insert 1, the condition of the treatment was as follows; a gas composition of $TiCl_4$ (1% by volume) with Ar the remaining gas component; a temperature of 1020° C.; a pressure of 50 Torr, a duration of 1 hour. For present insert 3, the conditions were as follows: a gas composition of $TiCl_4$ (0.2% by volume) with Ar the remaining gas component; a temperature of 1000° C.; a pressure of 150 Torr; and a duration of 2 hours. From a cross-sectional investigation using AES, a diffusion zone whose thickness was 0.9 $\mu$m for present insert 1 was observed while a diffusion zone having a thickness of 0.6 $\mu$m was observed for present insert 3. The atomic ratio of oxygen to titanium of the outer titanium oxide layer (w value) was investigated using AES, and they were almost identical to the target value as shown in Table 3.

From the investigation of the hard coating layers using an optical microscope, the thickness of each layer was almost identical to the designed thickness. Also from the investigation of the hard coating layer using X-ray diffraction, whose source was Cu K $\alpha$-radiation of 1.5 A wavelength, each $Al_2O_3$ layer had the maximum peak intensity at the same angle as that of the target.

Further, for coated cemented carbide inserts of the present invention 1 through 14 and conventional coated cemented carbide inserts 1 through 14, the following continuous and interrupted cutting tests were conducted. The wear width on the flank face was measured in each test. The results are shown in Table 6.

(1-1)

Cutting style: Continuous turning of stainless steel

Work piece: JIS SUS304 round bar

Cutting speed: 300 m/min.

Feed rate: 0.2 mm/rev.

Depth of cut: 1 mm

Cutting time: 10 min.

Coolant: Dry (1-2)

Cutting style: Interrupted turning of stainless steel

Work piece: JIS SUS304 round bar having 4 longitudinal grooves

Cutting speed: 200 m/min.

Feed rate: 0. 17 mm/rev.

Depth of cut: 1 mm

Cutting time: 3 min.

Coolant: Dry (1-3)

Cutting style: Interrupted turning of mild steel

Work piece: JIS S15C round bar having 4 longitudinal grooves

Cutting speed: 300 m/min.

Feed rate: 0.25 mm/rev.

Depth of cut: 1.5 mm

Cutting time: 5 min.

Coolant: Dry

TABLE 1

| Carbide | Composition (wt %) | | | | | |
|---|---|---|---|---|---|---|
| substrate | Co | (Ti, W)C | (Ti, W)CN | (Ta, Nb)C | $Cr_3C_2$ | WC |
| A | 6 | — | — | 1.5 | 0.4 | Balance |
| B | 6 | — | 8.5 | 3 | — | Balance |
| C | 7 | 3.5 | 5.5 | 4 | — | Balance |
| D | 8 | 4 | 4 | 5 | 0.5 | Balance |
| E | 9 | 21 | — | 2 | — | Balance |
| F | 10 | — | — | 2 | 0.6 | Balance |

TABLE 2

| Hard coating layer | Composition of reactive gas (volume %) | Ambience | |
|---|---|---|---|
| | | Pressure (Torr) | Temperature (° C.) |
| TiC | $TiCl_4$: 4.2%, $CH_4$: 8.5%, $H_2$: Balance | 50 | 1020 |
| TiN (1st layer) | $TiCl_4$: 4.2%, $N_2$: 30%, $H_2$: Balance | 200 | 900 |
| TiN (others) | $TiCl_4$: 4.2%, $N_2$: 35%, $H_2$: Balance | 200 | 1040 |
| I-TICN | $TiCl_4$: 4.2%, $N_2$: 20%, $CH_3CN$: 0.6%, $H_2$: Balance | 50 | 900 |
| TiCN | $TiCl_4$: 4.2%, $N_2$: 20%, $CH_4$: 4%, $H_2$: Balance | 50 | 1020 |
| TiCO | $TiCl_4$: 4.2%, CO: 4%, $H_2$: Balance | 50 | 1020 |
| TiCNO | $TiCl_4$: 4.2%, CO: 3%, $CH_4$: 3%, $N_2$: 20%, $H_2$: Balance | 100 | 1020 |
| $\alpha$-$Al_2O_3$① (target diffraction angle: 25.6°) | $AlCl_3$: 2.2%, $CO_2$: 5.5%, HCl: 2.2%, $H_2S$: 0.2%, $H_2$: Balance | 50 | 1000 |
| $\alpha$-$Al_2O_3$② (target diffraction angle: 35.1°) | $AlCl_3$: 4%, $CO_2$: 3%, HCl: 1%, $H_2S$: 0.2%, $H_2$: Balance | 50 | 1040 |
| $\alpha$-$Al_2O_3$③ (target diffraction angle: 37.8°) | $AlCl_3$: 2%, $CO_2$: 5%, CO: 2%, Ar: 25%, $H_2$: Balance | 50 | 1040 |
| $\alpha$-$Al_2O_3$④ (target diffraction angle: 43.4°) | $AlCl_3$: 2%, $CO_2$: 5%, $H_2$: Balance | 50 | 1020 |
| $\alpha$-$Al_2O_3$⑤ (target diffraction angle: 68.2°) | $AlCl_3$: 2.2%, $CO_2$: 5.5%, HCl: 1.1%, $H_2S$: 0.1%, $H_2$: Balance | 50 | 1000 |
| $\kappa$-$Al_2O_3$⑥ (target diffraction angle: 32.1°) | $AlCl_3$: 3.3%, $CO_2$: 5.5%, HCl: 1.1%, $H_2S$: 0.1%, $H_2$: Balance | 50 | 950 |
| $\kappa$-$Al_2O_3$⑦ (target diffraction angle: 34.9°) | $AlCl_3$: 3%, $CO_2$: 2%, HCl: 2%, $H_2S$: 0.3%, $H_2$: Balance | 50 | 950 |

TABLE 2-continued

| Hard coating layer | Composition of reactive gas (volume %) | Ambience Pressure (Torr) | Ambience Temperature (° C.) |
|---|---|---|---|
| $Al_2O_3/ZrO_2$ composite① (ground: α-$Al_2O_3$, $ZrO_2$: target 3 mol %) | $AlCl_3$: 3.3%, $ZrCl_4$: 1.1%, $CO_2$: 5%, HCl: 2.2%, $H_2$: Balance | 50 | 1000 |
| $Al_2O_3/ZrO_2$ composite② (ground: κ-$Al_2O_3$, $ZrO_2$: target 10 mol %) | $AlCl_3$: 1.1%, $ZrCl_4$: 3.3%, $CO_2$: 4%, HCl 2.2%, $H_2$: Balance | 50 | 950 |

TABLE 3

| Outer layer | Outer layer coating condition: Composition of reactive gas (volume %) | Ambience Pressure (Torr) | Ambience Temperature (° C.) |
|---|---|---|---|
| TiOw① (w = 1.25) | $TiCl_4$: 0.5%, $CO_2$: 0.2%, Ar: 40%, $H_2$: Balance | 200 | 1020 |
| TiOw② (w = 1.35) | $TiCl_4$: 3%, $CO_2$: 5%, Ar: 40%, $H_2$: Balance | 50 | 1000 |
| TiOw③ (w = 1.50) | $TiCl_4$: 3%, $CO_2$: 10%, Ar: 40%, $H_2$: Balance | 100 | 1000 |
| TiOw④ (w = 1.60) | $TiCl_4$: 1%, $CO_2$: 4.5%, Ar: 50%, $H_2$: Balance | 50 | 1000 |
| TiOw⑤ (w = 1.75) | $TiCl_4$: 1%, $CO_2$: 8%, Ar: 10%, $H_2$:Balance | 50 | 950 |
| TiOw⑥ (w = 1.90) | $TiCl_4$: 0.2%, $CO_2$: 5%, Ar: 5%, $H_2$: Balance | 50 | 900 |

the w value in parenthesis expresses target atomic ratio of oxygen against titanium

TABLE 4

| Insert | Substrate | Hard coating layer (Figure in parenthesis means designed thickness; μm): First layer | Second layer | Third layer | Forth layer | Fifth layer | Sixth layer | Seventh layer |
|---|---|---|---|---|---|---|---|---|
| This invention | | | | | | | | |
| 1 | A | TiN (0.5) | 1-TiCN (3) | TiC (1.8) | TiCNO (0.3) | α-$Al_2O_3$① (6) | TiOw① (0.5) | — |
| 2 | A | TiCN (0.2) | 1-TiCN (2) | α-$Al_2O_3$① (13.5) | TiOw② (1) | — | — | — |
| 3 | B | TiN (2) | TiCN (6) | TiC (1) | TiCO (1) | κ-$Al_2O_3$⑥ (2) | TiOw② (0.5) | — |
| 4 | B | TiC (3) | 1-TiCN (4) | TiCO (0.6) | α-$Al_2O_3$② (10) | TiOw③ (1) | — | — |
| 5 | C | TiN (0.5) | 1-TiCN (7) | TiC (1.5) | TiCNO (0.3) | α-$Al_2O_3$③ (5) | TiOw③ (1) | — |
| 6 | C | TiN (1) | TiCN (6) | TiN (1) | TiCNO (0.3) | κ-$Al_2O_3$⑥ (7) | TiC (1.5) | TiOw④ (2) |
| 7 | D | TiN (0.5) | 1-TiCN (12.5) | TiCNO (0.5) | α-$Al_2O_3$④ (15) | TiCN (1) | TiOw④ (0.1) | — |
| 8 | D | TiC (0.5) | 1-TiCN (6) | TiCO (0.4) | κ-$Al_2O_3$⑦ (7) | TiOw⑤ (0.5) | — | — |
| 9 | E | TiN (0.5) | TiC (3.5) | 1-TiCN (8) | TiCO (1) | α-$Al_2O_3$⑤ (2) | TiN (0.8) | TiOw⑤ (0.8) |
| 10 | F | TiN (1) | TiC (1.8) | α-$Al_2O_3$⑤ (1) | TiOx⑥ (0.1) | — | — | — |
| 11 | B | TiC (2) | 1-TiCN (6) | TiCNO (0.5) | composite② (8) | TiC (0.5) | α-$Al_2O_3$① (3) | TiOw③ (1.5) |
| 12 | D | TiC (3) | 1-TiCN (4) | TiCNO (0.6) | composite① (5) | κ-$Al_2O_3$⑥ (5) | TiOw⑤ (0.5) | — |
| 13 | E | TiN (1.5) | TiC (5) | 1-TiCN (6) | TiCO (0.6) | composite① (8) | TiN (0.8) | TiOw④ (2.5) |
| 14 | F | TiN (1) | TiC (2) | composite② (1) | TiOw② (3) | — | — | — |

TABLE 5

| Insert | Substrate | Hard coating layer (Figure in parenthesis means designed thickness; μm): First layer | Second layer | Third layer | Forth layer | Fifth layer | Sixth layer |
|---|---|---|---|---|---|---|---|
| Conventional | | | | | | | |
| 1 | A | TiN (0.5) | 1-TiCN (3) | TiC (1.8) | TiCNO (0.3) | α-$Al_2O_3$① (6) | — |
| 2 | A | TiCN (0.2) | 1-TiCN (2) | α-$Al_2O_3$① (13.5) | — | — | — |
| 3 | B | TiN (2) | TiCN (6) | TiC (1) | TiCO (1) | κ-$Al_2O_3$⑥ (2) | — |
| 4 | B | TiC (3) | 1-TiCN (4) | TiCO (0.6) | α-$Al_2O_3$② (10) | — | — |
| 5 | C | TiN (0.5) | 1-TiCN (7) | TiC (1.5) | TiCNO (0.3) | α-$Al_2O_3$③ (5) | — |

TABLE 5-continued

| Insert | Substrate | Hard coating layer (Figure in parenthesis means designed thickness; μm) | | | | | |
|---|---|---|---|---|---|---|---|
| | | First layer | Second layer | Third layer | Forth layer | Fifth layer | Sixth layer |
| 6 | C | TiN (1) | TiCN (6) | TiN (1) | TiCNO (0.3) | κ-$Al_2O_3$ 6 (7) | TiC (1.5) |
| 7 | D | TiN (0.5) | 1-TiCN (12.5) | TiCNO (0.5) | α-$Al_2O_3$ 4 (15) | TiCN (1) | — |
| 8 | D | TiC (0.5) | 1-TiCN (6) | TiCO (0.4) | κ-$Al_2O_3$ 7 (7) | — | — |
| 9 | E | TiN (0.5) | TiC (3.5) | 1-TiCN (8) | TiCO (1) | α-$Al_2O_3$ 5 (2) | TiN (0.8) |
| 10 | F | TiN (1) | TiC (1.8) | a-$Al_2O_3$ 5 (1) | — | — | — |
| 11 | B | TiC (2) | 1-TiCN (6) | TiCNO (0.5) | composite 2 (8) | TiC (0.5) | α-$Al_2O_3$ 1 (3) |
| 12 | D | TiC (3) | 1-TiCN (4) | TiCNO (0.6) | composite 1 (5) | κ-$Al_2O_3$ 6 (5) | — |
| 13 | E | TiN (1.5) | TiC (5) | 1-TiCN (6) | TiCO (0.6) | composite 1 (8) | TiN (0 8) |
| 14 | F | TiN (1) | TiC (2) | composite 2 (1) | — | — | — |

TABLE 6

| Insert | Flank wear (mm) | | |
|---|---|---|---|
| | Continuous turning of SUS304 | Interrupted turning of SUS304 | Interrupted turning of mild steel |
| This invention | | | |
| 1 | 0.31 | 0.24 | 0.28 |
| 2 | 0.29 | 0.26 | 0.26 |
| 3 | 0.32 | 0.26 | 0.29 |
| 4 | 0.35 | 0.32 | 0.33 |
| 5 | 0.33 | 0.31 | 0.34 |
| 6 | 0.33 | 0.29 | 0.29 |
| 7 | 0.3 | 0.29 | 0.34 |
| 8 | 0.31 | 0.31 | 0.28 |
| 9 | 0.28 | 0.23 | 0.32 |
| 10 | 0.29 | 0.29 | 0.31 |
| 11 | 0.35 | 0.32 | 0.32 |
| 12 | 0.31 | 0.3 | 0.3 |
| 13 | 0.32 | 0.27 | 0.32 |
| 14 | 0.27 | 0.27 | 0.28 |
| Conventional | | | |
| 1 | Failure at 5.2 min. | Failure at 0.6 min. | Failure at 2.5 min. |
| 2 | Failure at 3.0 min. | Failure at 1.2 min. | Failure at 4.1 min. |
| 3 | Failure at 6 0 min. | Faiiure at 1.1 min. | Failure at 0.9 min. |
| 4 | Failure at 4.2 min. | Failure at 0.7 min. | Failure at 1.9 min. |
| 5 | Failure at 4.6 min. | Failure at 0.7 min. | Failure at 2.7 min. |
| 6 | Failure at 5.8 min. | Failure at 0.5 min. | Failure at 2.2 min. |
| 7 | Failure at 3.3 min. | Failure at 0.9 min. | Failure at 2.4 min. |
| 8 | Failure at 1.1 min. | Failure at 1.1 min. | Failure at 1.8 min. |
| 9 | Failure at 4.9 min. | Failure at 0.4 min. | Faiiure at 1.0 min. |
| 10 | Failure at 3.4 min. | Failure at 1.6 min. | Failure at 2.6 min. |
| 11 | Failure at 3.5 min. | Failure at 0.9 min. | Failure at 0.9 min. |
| 12 | Failure at 2.4 min. | Failure at 0.6 min. | Failure at 2.1 min. |
| 13 | Failure at 3.0 min. | Failure at 1.3 min. | Failure at 0.6 min. |
| 14 | Failure at 7.6 min. | Failure at 2.0 min. | Failure at 3.7 min. |

All failures were caused by chipping occurred at cutting edge

Example 2

The same cemented carbide insert substrates A through F as in Example 1 were prepared.

The cutting edges of the cemented carbide insert substrates A through F were honed. Each substrate was subjected to chemical vapor deposition using conventional equipment under the conditions shown in Tables 2 and 3 to provide a hard coating layer on the substrate. In order to manufacture coated cemented carbide inserts in accordance with the present invention, a hard coating layer comprising a titanium compound layer, an $Al_2O_3$ layer, an outer titanium oxide layer, which supplies diffusing oxygen and an outermost titanium nitroxide layer formed from diffused oxygen was coated, wherein the designed coating layer structure and thickness of each layer is shown in Table 7. In order to manufacture conventional coated cemented carbide inserts, the same substrates and the coating layer structures, except for changing the outer titanium oxide layer and the outermost titanium nitroxide layer to a TiN layer, compared to the present invention, were applied. The designed coating layer structure and the thickness of each layer of conventional cemented carbide inserts are shown in Table 8. Coated cemented carbide inserts in accordance with the present invention 15 through 24 and conventional coated cemented carbide inserts 15 through 24 were manufactured in such a manner.

For coated cemented carbide inserts of the present invention 17 and 21, a treatment to improve interfacial adherence between the $Al_2O_3$ layer and the titanium oxide layer was applied after an outer titanium oxide layer was coated. For present insert 17, the condition of the treatment was as follows: a gas composition of $TiC_4$ (0.5% by volume) with the remaining gas component Ar; a temperature of 1000° C.; a pressure of 100 Torr; and a duration of 1 hour. For present insert 21, the condition was as follows: a gas composition of $TiCl_4$ (0.1% by volume) with Ar the remaining gas component; a temperature of 1000° C.; a pressure of 50 Torr and a duration of 2 hours. From the cross-sectional investigation using AES, a diffusion zone whose thickness was 0.6 μm was observed for present insert 17 and a diffusion zone of 0.8 μm was observed for present insert 21. The atomic ratio of oxygen to titanium at the outer titanium oxide layer (w value) and the atomic ratio of diffused oxygen to titanium at the outermost titanium nitroxide layer (y value) were investigated using AES, and the values are presented in Table 9.

From the investigation of the hard coating layers using an optical microscope, the thickness of each layer was almost identical to the designed thickness. Also from the investigation of the hard coating layer using X-ray diffraction, whose source was Cu K α-radiation at a wavelength of 1 .5 A, each $Al_2O_3$ layer has the maximum peak intensity at the same angle as that of the target.

Further, for coated cemented carbide inserts of the present invention 15 through 24 and conventional coated cemented carbide inserts 15 through 24, the following continuous and interrupted cutting tests were conducted. The wear width on each flank face was measured in each test. The results are shown in Table 9.

(2-1)

Cutting style: Continuous turning of alloyed steel

Work piece: JIS SCM440 round bar

Cutting speed: 350 m/min.

Feed rate: 0.2 mm/rev.

Depth of cut: 1.5 mm

Cutting time: 5 min.

Coolant: Dry (2-2)

Cutting style: Interrupted turning of alloyed steel

Work piece: JIS SNCM439 round bar having 4 longitudinal grooves

Cutting speed: 300 m/min.

Feed rate: 0.25 mm/rev.

Depth of cut: 1.5 mm

Cutting time: 5 min.

Coolant: Dry

TABLE 7

| Insert | Substrate | Hard coating layer (Figure in parenthesis means designed thickness; μm) | | | | | | |
|---|---|---|---|---|---|---|---|---|
| | | First layer | Second layer | Third layer | Forth layer | Fifth layer | Sixth layer | Seventh layer |
| This invention | | | | | | | | |
| 15 | A | TiN (0.5) | 1-TiCN (3) | TiC (1.8) | TiCNO (0.3) | α-$Al_2O_3$(1) (6) | TiOw(1) (0.5) | TiN(O) (0.2) |
| 16 | A | TiCN (0.2) | 1-TiCN (2) | TiCNO (0.1) | α-$Al_2O_3$(1) (13.5) | TiOw(2) (1) | TiN(O) (0.5) | — |
| 17 | B | TiN (2) | TiCN (6) | TiC (1) | TiCO (1) | κ-$Al_2O_3$(6) (2) | TiOw(2) (0.5) | TiN(O) (0.1) |
| 18 | B | TiC (3) | 1-TiCN (4) | TiCO (0.6) | α-$Al_2O_3$(1) (10) | TiOw(3) (1) | TiN(O) (0.4) | — |
| 19 | C | TiN (0.5) | 1-TiCN (7) | TiC (1.5) | TiCNO (0.3) | α-$Al_2O_3$(2) (5) | TiOw(3) (1) | TiN(O) (0.5) |
| 20 | C | TiN (1) | TiCN (6) | TiN (1) | TiCNO (0.3) | κ-$Al_2O_3$(6) (7) | TiOw(4) (2) | TiN(O) (1) |
| 21 | D | TiN (0.5) | 1-TiCN (12.5) | TiCNO (0.5) | α$Al_2O_3$(3) (15) | TiOw(4) (0.1) | TiN(O) (0.05) | — |
| 22 | D | TiC (0.5) | 1-TiCN (6) | TiCO (0.4) | κ-$Al_2O_3$(7) (7) | TiOw(5) (0.5) | TiN(O) (0.2) | — |
| 23 | E | TiN (0.5) | TiC (3.5) | 1-TiCN (8) | TiCO (1) | α-$Al_2O_3$(4) (2) | TiOw(5) (0.8) | TiN(O) (0.3) |
| 24 | F | TiCN (1) | 1-TiCN (9) | TiC (1.8) | TiCO (0.3) | α-$Al_2O_3$(5) (1) | TiOw(6) (0.1) | TiN(O) (0.2) |

TABLE 8

| Insert | Substrate | Hard coating layer (Figure in parenthesis means designed thickness; μm) | | | | | |
|---|---|---|---|---|---|---|---|
| | | First layer | Second layer | Third layer | Forth layer | Fifth layer | Sixth layer |
| Conventional | | | | | | | |
| 15 | A | TiN (0.5) | 1-TiCN (3) | TiC (1.8) | TiCNO (0.3) | α-$Al_2O_3$(1) (6) | TiN (0.2) |
| 16 | A | TiCN (0.2) | 1-TiCN (2) | TiCNO (0.1) | α-$Al_2O_3$(1) (13.5) | TiN (0.5) | — |
| 17 | B | TiN (2) | TiCN (6) | TiC (1) | TiCO (1) | κ-$Al_2O_3$(6) (2) | TiN (0.1) |
| 18 | B | TiC (3) | 1-TiCN (4) | TiCO (0.6) | α-$Al_2O_3$(1) (10) | TiN (0.4) | — |
| 19 | C | TiN (0.5) | 1-TiCN (7) | TiC (1.5) | TiCNO (0.3) | α-$Al_2O_3$(2) (5) | TiN (0.5) |
| 20 | C | TiN (1) | TiCN (6) | TiN (1) | TiCNO (0.3) | κ-$Al_2O_3$(6) (7) | TiN (1) |
| 21 | D | TiN (0.5) | 1-TiCN (12.5) | TiCNO (0.5) | α-$Al_2O_3$(3) (15) | TiN (0.05) | — |
| 22 | D | TiC (0.5) | 1-TiCN (6) | TiCO (0.4) | κ-$Al_2O_3$(7) (7) | TiN (0.2) | — |
| 23 | E | TiN (0.5) | TiC (3.5) | 1-TiCN (8) | TiCO (1) | α-$Al_2O_3$(4) (2) | TiN (0.3) |
| 24 | F | TiCN (1) | 1-TiCN (9) | TiC (1.8) | TiCO (0.3) | α-$Al_2O_3$(5) (1) | TiN (0.2) |

TABLE 9

| Insert | W value at outerlayer | Y value at outermost layer | Flank wear (mm) | | Insert | Flank wear (mm) | |
|---|---|---|---|---|---|---|---|
| | | | Continuous turning | Interrupted turning | | Continuous turning | Interrupted turning |
| This invention | | | | | Conventional | | |
| 15 | 1.22 | 0.03 | 0.28 | 0.21 | 15 | Failure at 1.4 min. | Failure at 1.8 min. |
| 16 | 1.30 | 0.21 | 0.24 | 0.2 | 16 | Failure at 0.9 min. | Failure at 0.3 min. |
| 17 | 1.39 | 0.11 | 0.23 | 0.22 | 17 | Failure at 0.7 min. | Failure at 1.2 min. |
| 18 | 1.37 | 0.18 | 0.3 | 0.29 | 18 | Failure at 0 7 min. | Failure at 0.4 min. |
| 19 | 1.31 | 0.24 | 0.28 | 0.22 | 19 | Failure at 1.9 min. | Failure at 0.9 min. |
| 20 | 1.28 | 0.32 | 0.22 | 0.2 | 20 | Failure at 2.0 min. | Failure at 1.5 min. |
| 21 | 1.56 | 0.08 | 0.33 | 0.22 | 21 | Failure at 1.8 min. | Failure at 1.8 min. |
| 22 | 1.64 | 0.19 | 0.31 | 0.25 | 22 | Failure at 0.5 min. | Failure at 0.9 min. |
| 23 | 1.55 | 0.23 | 0.31 | 0.19 | 23 | Failure at 0.7 min. | Failure at 1.2 min. |
| 24 | 1.50 | 0.38 | 0.32 | 0.26 | 24 | Failure at 0.7 min. | Failure at 1.1 min. |

All failures were caused by chipping occurred at cutting edge

Example 3

Figure 2A:
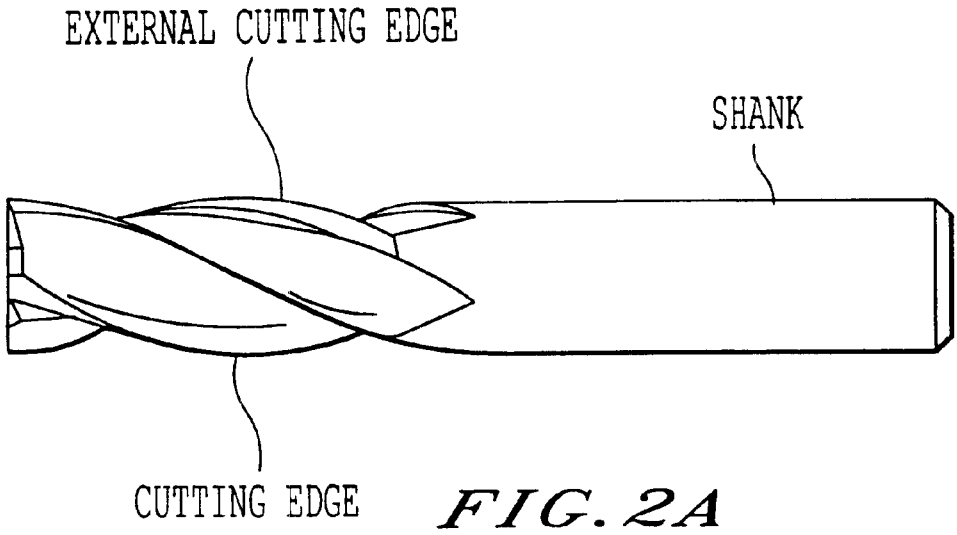
FIG. 2 is an outline sketch of a coated cemented carbide end-mill (a), and a cross-sectional image of the end-mill (b)
Figure 2B:
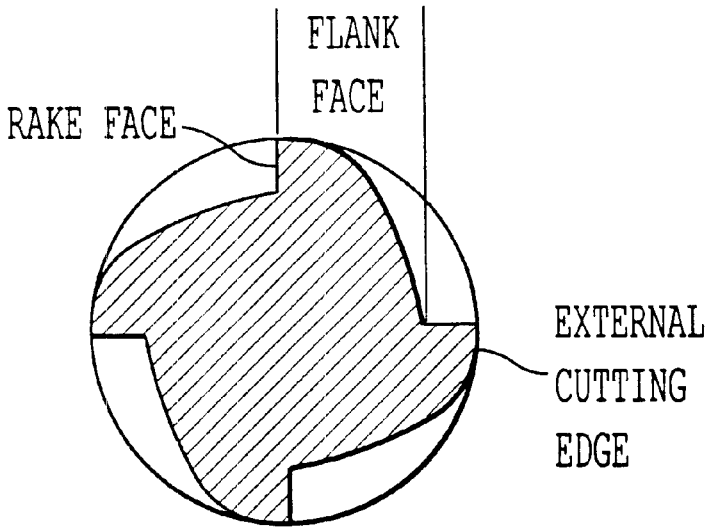

The following powders were prepared as raw materials: a coarse WC powder with an average grain size of 5.5 μm; a fine WC powder with an average grain size of 0.8 μm; a TaC powder with an average grain size of 1.3 μm; a NbC powder with an average grain size of 1.2 μm; a ZrC powder of an average grain size of 1.2 μm; a $Cr_3C_2$ powder with an average grain size of 2.3 μm; a VC powder of an average grain size of 1.5 μm; a (Ti,W)C powder with an average grain size of 1.0 μm; a Co powder with an average grain size of 1.8 μm; and a carbon powder with an average grain size of 1.2 μm. A number of powder mixtures were prepared by compounding having the formulations shown in Table 10 with wax in acetone solvent. Each powder mixture was wet-mixed in a ball mill for 24 hours, and dried. After each dry mixture was pressed at a pressure of 1 ton/$cm^2$ to form a green compact, each green compact was sintered under the following conditions: a pressure of 0.05 Torr; a heating rate of 7° C./min.; a temperature of 1370 to 1470° C. and a holding duration of 1 hour, to manufacture cemented carbide materials whose shapes were columns having diameters of 8 mm, 13 mm and 26 mm. Further, cemented carbide end-mill substrates a through h having the following sizes: ϕ6 mm×13 mm, ϕ10 mm×22 mm and ϕ20 mm×45 mm, whose shapes and compositions are shown in FIG. 2 and Table 10, were manufactured by a grinding process from said columnar cemented carbide materials.

The cutting edges of the cemented carbide end-mill substrates a through h were honed. Each substrate was subjected to chemical vapor deposition using conventional equipment under the conditions shown in Tables 2 and 3 to provide hard coating layers on the substrates. In order to manufacture coated cemented carbide end-mills in accordance with the present invention, a hard coating layer comprising a titanium compound layer, an $Al_2O_3$ layer and an outer titanium oxide layer was coated on each substrate, wherein the designed coating layer structure and thickness of each layer is shown in Table 11. In order to manufacture conventional coated cemented carbide end-mills, the same substrates and coating layer structures, but outer titanium oxide layers compared to the present invention, were applied, wherein the designed coating layer structure and thickness of each layer is shown in Table 12. Coated cemented carbide end-mills in accordance with the present invention 1 through 8 and conventional coated cemented carbide end-mills 1 through 8 were thus manufactured.

Further, for coated cemented carbide end-mills of the present invention 1 through 3 and conventional coated cemented carbide end-mills 1 through 3, the following cutting tests were conducted.

(3-1)

Cutting style: Groove milling on stainless steel

Work piece: 100 mm×250 mm, thickness: 50 mm, JIS SUS304 square bar

Cutting speed: 60 m/min.

Table feed rate: 200 mm/min.

Depth of cut: 3 mm

Coolant: Water-soluble coolant

For coated cemented carbide end-mills of the present invention 4 through 6 and conventional coated cemented carbide end-mills 4 through 6, the following cutting tests were conducted.

(3-2)

Cutting style: Groove milling on mild steel

Work piece: 100 mm×250 mm, thickness: 50 mm, JIS S15C square bar

Cutting speed: 80 m/min.

Table feed rate: 400 mm/min.

Depth of cut: 6 mm

Coolant: Dry

For coated cemented carbide end-mills of the present invention 7 and 8, and conventional coated cemented carbide end-mills 7 and 8, the following cutting tests were conducted.

(3-3)

Cutting style: Groove milling on stainless steel

Work piece: 100 mm×250 mm, thickness: 50 mm, JIS SUS304 square bar

Cutting speed: 70 m/min.

Table feed rate: 200 mm/min.

Depth of cut: 15 mm

Coolant: Water-soluble coolant

For each groove milling test, the total groove length which is able to be produced until the diameter of the bottom blade of the end-mill had decreased 0.20 mm compared to the original, was measured. The results are shown in Tables 11 and 12.

TABLE 10

| Carbide substrate for | Composition (wt%) | | | | | | | | Size (diameter × length: |
|---|---|---|---|---|---|---|---|---|---|
| end-mill | Co | (Ti,W)C | TaC | NbC | ZrC | Cr3C2 | VC | WC | mm) |
| a | 5 | 5 | — | — | — | — | — | Coarse:Balance | ϕ 6 × 13 |
| b | 6 | — | 1 | 0.5 | — | — | — | Fine:Balance | ϕ 6 × 13 |
| c | 6 | — | 1 | — | 1 | 0.5 | 0.5 | Fine:Balance | ϕ 6 × 13 |
| d | 8 | — | — | — | — | 0.5 | 0.5 | Fine:Balance | ϕ 10 × 22 |
| e | 9 | 25 | 10 | 1 | — | — | — | Coarse:Balance | ϕ 10 × 22 |
| f | 10 | — | — | — | — | 1 | — | Fine:Balance | ϕ 10 × 22 |
| g | 12 | 17 | 9 | 1 | — | — | — | Coarse:Balance | ϕ 20 × 45 |
| h | 16 | — | 10 | — | 10 | — | — | Coarse:Balance | ϕ 20 × 45 |

TABLE 11

| End-mill | | Substrate | Hard coating layer (Figure in parenthesis means designed thickness; μm) First layer | Second layer | Third layer | Forth layer | Fifth layer | Sixth layer | Cutting length (m) |
|---|---|---|---|---|---|---|---|---|---|
| This invention | 1 | a | TiN (0.5) | 1-TiCN (2) | α-$Al_2O_3$ (1) (2.5 | TiOw (1) (1) | — | — | 71 |
| | 2 | b | TiN (2) | TiCN (1) | composite (2) (1) | TiCO (0.3) | composite (1) (2) | TiOw (2) (0.5) | 59 |
| | 3 | c | TiN (0.5) | 1-TiCN (3) | composite (2) (1) | α-$Al_2O_3$ (3) (1) | TiOw (3) (1) | — | 49 |
| | 4 | d | TiC (0.5) | TiC (2) | TiCNO (0.5) | κ-$Al_2O_3$ (6) (3) | TiOw (3) (2.5) | — | 87 |
| | 5 | e | TiN (0.5) | 1-TiCN (4) | TiC (1.5) | TiCNO (0.3) | α-$Al_2O_3$ (2) (2) | TiOw (4) (1) | 126 |
| | 6 | f | TiN (1) | TiCN (3) | TiN (1) | TiCNO (0.5) | κ-$Al_2O_3$ (6) (3) | TiOw (4) (0.1) | 55 |
| | 7 | g | TiN (0.5) | composite (1) (1) | α-$Al_2O_3$ (4) (2) | TiCN (1) | TiOw (5) (0.5) | — | 50 |
| | 8 | h | TiC (0.5) | 1-TiCN (2) | TiCO (0.4) | κ-$Al_2O_3$ (7) (3) | TiOw (6) (0.5) | — | 62 |

TABLE 12

| End-mill | | Substrate | Hard coating layer (Figure in parenthesis means designed thickness; μm) First layer | Second layer | Third layer | Forth layer | Fifth layer | Cutting length (m) |
|---|---|---|---|---|---|---|---|---|
| Conventional | 1 | a | TiN (0.5) | 1-TiCN (2) | α-$Al_2O_3$ (1) (2.5) | — | — | 35 |
| | 2 | b | TiN (2) | TiCN (1) | composite (2) (1) | TiCO (0.3) | composite (1) (2) | 13 |
| | 3 | c | TiN (0.5) | 1-TiCN (3) | composite (2) (1) | α-$Al_2O_3$ (3) (1) | — | 11 |
| | 4 | d | TiC (0.5) | TiC (2) | TiCNO (0.5) | κ-$Al_2O_3$ (6) (3) | — | 29 |
| | 5 | e | TiN (0.5) | 1-TiCN (4) | TiC (1.5) | TiCNO (0.3) | α-$Al_2O_3$ (2) (2) | 44 |
| | 6 | f | TiN (1) | TiCN (3) | TiN (1) | TiCNO (0.5) | κ-$Al_2O_3$ (6) (3) | 17 |
| | 7 | g | TiN (0.5) | composite (1) (1) | α-$Al_2O_3$ (4) (2) | TiCN (1) | — | 18 |
| | 8 | h | TiC (0.5) | 1-TiCN (2) | TiCO (0.4) | κ-$Al_2O_3$ (7) (3) | — | 6 |

Example 4

The same cemented carbide end-mill substrates a through h as in Example 3 were prepared.

The cutting edges of the cemented carbide end-mill substrates a through h were honed. Each substrate was subjected to chemical vapor deposition using conventional equipment under the conditions shown in Tables 2 and 3 to provide hard coating layers on the substrates. In order to manufacture coated cemented carbide end-mills in accordance with the present invention, a hard coating layer comprising a titanium compound layer, an $Al_2O_3$ layer, an outer titanium oxide layer which supplies diffusion oxygen and an outermost titanium nitroxide layer involving diffused oxygen was coated, wherein the designed coating layer structure and thickness of each layer is shown in Table 13. In order to manufacture conventional coated cemented carbide end-mills, the same coating conditions, except for changing the outer titanium oxide layer and the outermost titanium nitroxide layer to TiN layer, as the present invention were applied, wherein the designed coating layer structure and the thickness of each layer is shown in Table 14. Coated cemented carbide end-mills in accordance with the present invention 9 through 16 and conventional coated cemented carbide end-mills 9 through 16 were manufactured in this manner.

Further, for coated cemented carbide end-mills of the present invention 9 through 11 and conventional coated cemented carbide end-mills 9 through 11, the following cutting tests were conducted.

(4-1)

Cutting style: Groove milling on alloyed steel

Work piece: 100 mm×250 mm, thickness: 50 mm, JIS SCM440 square bar

Cutting speed: 80 m/min.

Table feed rate: 500 mm/min.

Depth of cut: 3 mm

Coolant: Dry

For coated cemented carbide end-mills of the present invention 12 through 14 and conventional coated cemented carbide end-mills 12 through 14, the following cutting tests were conducted.

(4-2)

Cutting style: Groove milling on alloyed steel

Work piece: 100 mm×250 mm, thickness: 50 mm, JIS SCM440 square bar

Cutting speed: 90 m/min.

Table feed rate: 500 mm/min.

Depth of cut: 6 mm

Coolant: Dry

For coated cemented carbide end-mills of the present invention 15 and 16, and conventional coated cemented carbide end-mills 15 and 16, the following cutting tests were conducted.

(4-3)

Cutting style: Groove milling on alloyed steel

Work piece: 100 mm×250 mm, thickness: 50 mm, JIS SCM415 square bar

Cutting speed: 90 m/min.

Table feed rate: 500 mm/min.

Depth of cut: 15 mm

Coolant: Dry

For each groove milling test, the total groove length which is able to be produced until the diameter of bottom blade of the end-mill had decreased 0.20 mm compared to the original, was measured. The results are shown in Tables 13 and 14.

TABLE 13

| End-mill | | Substrate | Hard coating layer (Figure in parenthesis means designed thickness; μm) First layer | Second layer | Third layer | Forth layer | Fifth layer | Sixth layer | Seventh layer | Cutting length (m) |
|---|---|---|---|---|---|---|---|---|---|---|
| This invention | 1 | a | TiN (0.2) | 1-TiCN (2) | α-$Al_2O_3$ 1 (2.5) | TiOw 1 (0.5) | TiN(O) (0.2) | — | — | 153 |
| | 2 | b | TiN (2) | TiCN (1) | TiC (3.5) | TiCO (0.3) | α-$Al_2O_3$ 2 (2) | TiOw 2 (1) | TiN(O) (0.5) | 99 |
| | 3 | c | TiN (0.5) | 1-TiCN (3e) | TiCNO (0.5) | α-$Al_2O_3$ 3 (1) | TiOw 3 (1) | TiN(O) (0.4) | — | 172 |
| | 4 | d | TiC (0.5) | TiC (2) | TiCNO (0.5) | κ-$Al_2O_3$ 6 (3) | TiOw 3 (1) | TiN(O) (0.5) | — | 181 |
| | 5 | e | TiN (0.5) | 1-TiCN (4) | TiC (1.5) | TiCNO (0.3) | α-$Al_2O_3$ 2 (2) | TiOw 4 (3) | TiN(O) (1) | 180 |
| | 6 | f | TiN (1) | TiCN (3) | TiN (1) | TiCNO (0.5) | κ-$Al_2O_3$ 6 (3) | TiOw 4 (0.1) | TiN(O) (0.05) | 106 |
| | 7 | g | TiN (0.5) | TiC (2) | α-$Al_2O_3$ 4 (2) | TiCN (1) | TiOw 5 (0.5) | TiN(O) (0.2) | — | 247 |
| | 8 | h | TiC (0.5) | 1-TiCN (2) | TiCO (0.4) | κ-$Al_2O_3$ 7 (3) | TiOw 6 (0.1) | TiN(O) (0.2) | — | 127 |

TABLE 14

| End-mill | | Substrate | Hard coating layer (Figure in parenthesis means designed thickness; μm) First layer | Second layer | Third layer | Forth layer | Fifth layer | Sixth layer | Cutting length (m) |
|---|---|---|---|---|---|---|---|---|---|
| Conventional | 1 | a | TiN (0.2) | 1-TiCN (2) | α-$Al_2O_3$ 1 (2.5) | TiN (0.2) | | — | 52 |
| | 2 | b | TiN (2) | TiCN (1) | TiC (3.5) | TiCO (0.3) | α-$Al_2O_3$ 2 (2) | TiN (0.5) | 28 |
| | 3 | c | TiN (0.5) | 1-TiCN (3) | TiCNO (0.5) | α-$Al_2O_3$ 3 (1) | TiN (0.4) | | 63 |
| | 4 | d | TiC (0.5) | TiC (2) | TiCNO (0.5) | κ-$Al_2O_3$ 6 (3) | TiN (0.5) | | 55 |
| | 5 | e | TiN (0.5) | 1-TiCN (4) | TiC (1.5) | TiCNO (0.3) | α-$Al_2O_3$ 2 (2) | TiN (1) | 30 |
| | 6 | f | TiN (1) | TiCN (3) | TiN (1) | TiCNO (0.5) | κ-$Al_2O_3$ 6 (3) | TiN (0.05) | 47 |
| | 7 | g | TiN (0.5) | TiC (2) | α-$Al_2O_3$ 4 (2) | TiCN (1) | TiN (0.2) | | 14 |
| | 8 | h | TiC (0.5) | 1-TiCN (2) | TiCO (0.4) | κ-$Al_2O_3$ 7 (3) | TiN (0.2) | | 43 |

Example 5

The same cemented carbide materials whose shapes were column with diameters of 8 mm, 13 mm and 26 mm as in Example 3 were prepared.

Figure 3A:
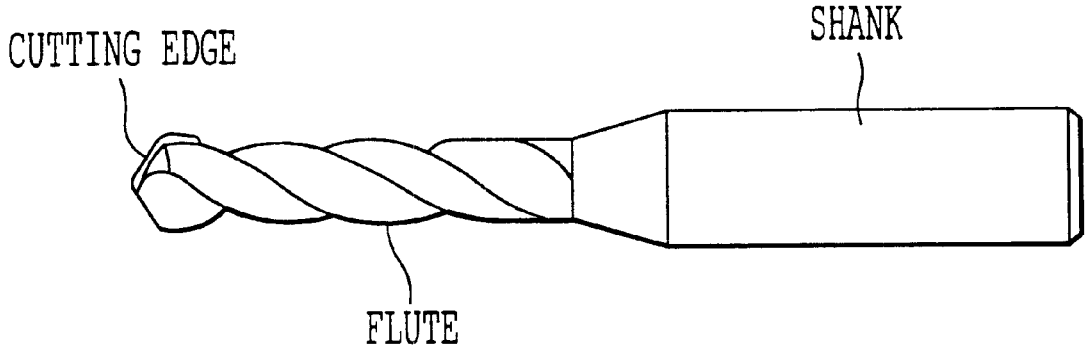
FIG. 3 is an outline sketch of the coated cemented carbide drill (a), and a cross-sectional image of the drill (b).
Figure 3B:
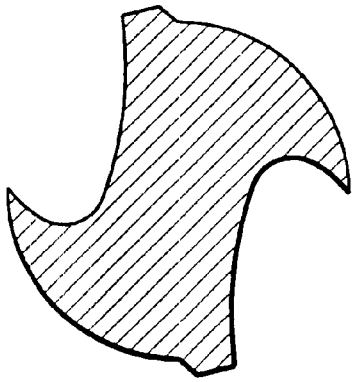

Cemented carbide drill substrates a' through h' having the following sizes: ϕ4 mm×13 mm, ϕ8 mm×22 mm and ϕ16 mm×45 mm, whose shapes and compositions are shown in FIG. 3 and Table 15, were manufactured by a grinding process from said columnar cemented carbide materials.

The cutting edges of the cemented carbide drill substrates a' through h' were honed. Each substrate was subjected to chemical vapor deposition using conventional equipment under the conditions shown in Tables 2 and 3 to provide hard coating layers on the substrates. In order to manufacture coated cemented carbide drills in accordance with the present invention, a hard coating layer comprising a titanium compound layer, an $Al_2O_3$ layer and an outer titanium oxide layer was coated on each substrate, wherein the designed coating layer structure and thickness of each layer is shown in Table 16. In order to manufacture conventional coated cemented carbide drills, the same substrates and coating layer structures, but outer titanium oxide layer compared to the present invention, were applied, wherein the designed coating layer structure and thickness of each layer is shown in Table 17. Coated cemented carbide drills in accordance with the present invention 1 through 8 and conventional coated cemented carbide drills 1 through 8 were thus manufactured.

Further, for coated cemented carbide drills of the present invention 1 through 3 and conventional coated cemented carbide drills 1 through 3, the following cutting tests were conducted.

(5-1)

Cutting style: Drilling on stainless steel

Work piece: 100 mm×250 mm, thickness: 50 mm, JIS SUS304 square bar

Cutting speed: 25 m/min.

Feed rate: 0.1 mm/rev.

Coolant: Water-soluble coolant

For coated cemented carbide drills of the present invention 4 through 6 and conventional coated cemented carbide drills 4 through 6, the following cutting tests were conducted.

(5-2)

Cutting style: Drilling on stainless steel

Work piece: 100 mm×250 mm, thickness: 50 mm, JIS SUS304 square bar

Cutting speed: 30 m/min.

Feed rate: 0.15 mm/rev.

Coolant: Water-soluble coolant

For coated cemented carbide drills of the present invention 7 and 8, and conventional coated cemented carbide drills 7 and 8, the following cutting tests were conducted.

(5-3)

Cutting style: Drilling on mild steel

Work piece: 100 mm×250 mm, thickness: 50 mm, JIS S15C square bar

Cutting speed: 70 m/min.

Feed rate: 0.35 mm/rev.

Coolant: Water-soluble coolant

For each drilling test, the number of holes which could be drilled until flank wear of the drill reached to 0.30 mm, was counted. The results are shown in Tables 16 and 17.

TABLE 15

| Carbide substrate for drill | Co | (Ti, W)C | TaC | NbC | ZrC | Cr3C2 | VC | WC | Size (diameter × length: mm) |
|---|---|---|---|---|---|---|---|---|---|
| | Composition (wt %) | | | | | | | | |
| a' | 5 | 5 | — | — | — | — | — | Coarse: Balance | ϕ4 × 13 |
| b' | 6 | — | 1 | 0.5 | — | — | — | Fine: Balance | ϕ4 × 13 |
| c' | 6 | — | 1 | — | 1 | 0.5 | 0.5 | Fine: Balance | ϕ4 × 13 |
| d' | 8 | — | — | — | — | 0.5 | 0.5 | Fine: Balance | ϕ8 × 22 |
| e' | 9 | 25 | 10 | 1 | — | — | — | Coarse: Balance | ϕ8 × 22 |
| f' | 10 | — | — | — | — | 1 | — | Fine: Balance | ϕ8 × 22 |
| g' | 12 | 17 | 9 | 1 | — | — | — | Coarse: Balance | ϕ16 × 45 |
| h' | 16 | — | 10 | — | 10 | — | — | Coarse: Balance | ϕ16 × 45 |

15

TABLE 16

| Drill | | Substrate | First layer | Second layer | Third layer | Forth layer | Fifth layer | Sixth layer | Number of holes |
|---|---|---|---|---|---|---|---|---|---|
| | | | Hard coating layer (Figure in parenthesis means designed thickness; μm) | | | | | | |
| This invention | 1 | a' | TiCN (0.2) | 1-TiCN (3) | α-$Al_2O_3$ 1 (2) | TiOw 1 (1) | — | — | 1600 |
| | 2 | b' | TiN (2) | TiCN (1) | composite 2 (1) | TiCO (0.3) | composite 1 (2) | TiOw 2 (0.5) | 1200 |
| | 3 | c' | TiN (0.5) | 1-TiCN (3) | composite 2 (1) | α-$Al_2O_3$ 3 (1) | TiOw 3 (1) | — | 1850 |
| | 4 | d' | TiC (0.5) | TiC (2) | TiCNO (0.5) | κ-$Al_2O_3$ 5 (3) | TiOw 3 (2.5) | — | 1050 |
| | 5 | e' | TiN (0.5) | 1-TiCN (4) | TiC (1.5) | TiCNO (0.3) | α-$Al_2O_3$ 2 (2) | TiOw 4 (1) | 1100 |
| | 6 | f' | TiN (1) | TiCN (3) | TiCNO (0.5) | κ-$Al_2O_3$ 6 (3) | TiOw 4 (0.1) | — | 850 |
| | 7 | g' | TiN (0.5) | composite 1 (1) | α-$Al_2O_3$ 4 (2) | TiCN (1) | TiOw 5 (0.5) | — | 1900 |
| | 8 | h' | TiC (0.5) | 1-TiCN (2) | TiCO (0.4) | κ-$Al_2O_3$ 7 (3) | TiOw 6 (0.5) | — | 1750 |

TABLE 17

| Drill | | Substrate | First layer | Second layer | Third layer | Forth layer | Fifth layer | Number of holes |
|---|---|---|---|---|---|---|---|---|
| | | | Hard coating layer (Figure in parenthesis means designed thickness; μm) | | | | | |
| Conventional | 1 | a' | TiCN (0.2) | 1-TiCN (3) | α-$Al_2O_3$ 1 (2) | — | — | 600 |
| | 2 | b' | TiN (2) | TiCN (1) | composite 2 (1) | TiCO (0.3) | composite 1 (2) | 450 |
| | 3 | c' | TiN (0.5) | 1-TiCN (3) | composite 2 (1) | α-$Al_2O_3$ 3 (1) | — | 550 |
| | 4 | d' | TiC (0.5) | TiC (2) | TiCNO (0.5) | κ-$Al_2O_3$ 6 (3) | — | 550 |
| | 5 | e' | TiN (0.5) | 1-TiCN (4) | TiC (1.5) | TiCNO (0.3) | α-$Al_2O_3$ 2 (2) | 600 |
| | 6 | f' | TiN (1) | TiCN (3) | TiCNO (0.5) | κ-$AL_2O_3$ 6 (3) | — | 300 |
| | 7 | g' | TiN (0.5) | composite 1 (1) | α-$Al_2O_3$ 4 (2) | TiCN (1) | — | 950 |
| | 8 | h' | TiC (0.5) | 1-TiCN (2) | TiCO (0.4) | κ-$Al_2O_3$ 7 (3) | — | 950 |

Example 6

The same cemented carbide drill substrates a' through h' as in Example 5 were prepared.

The cutting edges of the cemented carbide drill substrates a' through h' were honed Each substrate was subjected to chemical vapor deposition using conventional equipment under the conditions shown in Tables 2 and 3 to provide hard coating layers on the substrates. In order to manufacture coated cemented carbide drills in accordance with the present invention, a hard coating layer comprising a titanium compound layer, an $Al_2O_3$ layer, and an outer titanium oxide layer which supplies diffusion oxygen and an outermost titanium nitroxide layer which receives the diffused oxygen, was coated on the coated cutting edges, wherein the designed coating layer structure and thickness of each layer is shown in Table 18. In order to manufacture conventional coated cemented carbide drills, the same coating conditions, except for changing the outer titanium oxide layer and the outermost titanium nitroxide layer to a TiN layer, as in the present invention, were applied, wherein the designed coating layer structure and thickness of each layer is shown in Table 19. Coated cemented carbide drills in accordance with the present invention 9 through 16 and conventional coated cemented carbide drills 9 through 16 were manufactured in such a manner.

Further, for coated cemented carbide drills of the present invention 9 through 11 and conventional coated cemented carbide drills 9 through 11, the following cutting tests were conducted.

(6-1)

Cutting style: Drilling on alloyed steel

Work piece: 100 mm×250 mm, thickness: 50 mm, JIS SCM440 square bar

Cutting speed: 50 m/min.

Feed rate: 0.2 mm/rev.

Coolant: Water-soluble coolant

For coated cemented carbide drills of the present invention 12 through 14 and conventional coated cemented carbide drills 12 through 14, the following cutting tests were conducted.

(6-2)

Cutting style: Drilling on alloyed steel

Work piece: 100 mm×250 mm, thickness: 50 mm, JIS SCM440 square bar

Cutting speed: 60 m/min.

Feed rate: 0.2 mm/rev.

Coolant: Water-soluble coolant

For coated cemented carbide drills of the present invention 15 and 16, and conventional coated cemented carbide drills 15 and 16, the following cutting tests were conducted.

(6-3)

Cutting style: Drilling on alloyed steel

Work piece: 100 mm×250 mm, thickness: 50 mm, JIS SCM415 square bar

Cutting speed: 75 m/min.

Feed rate: 0.35 mm/rev.

Coolant: Water-soluble coolant

For each drilling test, the number of holes which could be drilled until flank wear of the drill had reached 0.30 mm was counted. The results are shown in Tables 18 and 19.

Obviously, numerous modifications and variations of the present invention are possible in light of the above teachings. It is, therefore, to be understood that within the scope of the appended claims, the invention may be practiced otherwise than as specifically described herein

What is claimed as new and is intended to be secured by Letters Patent is:

1. A coated cemented carbide cutting member for a cutting tool comprising a substrate and a hard coating layer on said substrate, wherein said hard coating layer comprises at least one layer selected from the group consisting of titanium carbide, titanium nitride, titanium cabonitride, titanium carboxide, titanium carbonitroxide, aluminum oxide, and aluminum oxide-ziconium oxide composite in which zicronium oxide phases are dispersed around ground aluminum oxide phases, and wherein said hard coating layer is provided with an outermost layer which comprises titanium oxide which is expressed by the molecular formula $TiO_w$ , wherein w is the atomic ratio of oxygen to titanium which ranges from 1.20 to 1.90.

2. The article of claim 1, wherein said outermost layer has a thickness of 0.1 to 3 μm.

3. The article of claim 2, wherein said outermost layer thickness ranges from 0.2 to 1.5 μm.

TABLE 18

| Drill | | Substrate | Hard coating layer (Figure in parenthesis means designed thickness; μm) | | | | | | | Number |
|---|---|---|---|---|---|---|---|---|---|---|
| | | | First layer | Second layer | Third layer | Forth layer | Fifth layer | Sixth layer | Seven layer | of holes |
| This | 1 | a' | TiCN (0.2) | 1-TiCN (2) | α-$Al_2O_3$(1) (2) | TiOw(1) (0.5) | TiN(O) (0.2) | — | — | 1950 |
| invention | 2 | b' | TiN (0.1) | TiCN (1) | TiC (1.5) | TiCO (0.3) | α-$Al_2O_3$(2) (2) | TiOw(2) (0.7) | TiN(O) (0.3) | 1550 |
| | 3 | c' | TiN (0.5) | 1-TiCN (2) | TiCNO (0.5) | α-$Al_2O_3$(3) (1) | TiOw(3) (0.5) | TiN(O) (0.1) | — | 1600 |
| | 4 | d' | TiC (0.5) | TiC (2) | TiCNO (0.5) | κ-$Al_2O_3$(6) (1) | TiOw(3) (0.2) | TiN(O) (0.2) | — | 1800 |
| | 5 | e' | TiN (0.5) | 1-TiCN (2) | TiC (1) | TiCNO (0.3) | α-$Al_2O_3$(2) (2) | TiOw(4) (1) | TiN(O) (0.5) | 1850 |
| | 6 | f' | TiN (1) | TiCN (1) | TiN (1) | TiCNO (0.5) | κ-$Al_2O_3$(6) (2) | TiOw(4) (0.1) | TiN(O) (0.05) | 1350 |
| | 7 | g' | TiN (0.5) | TiC (2) | α-$Al_2O_3$(4) (2) | TiCN (1) | TiOw(5) (0.5) | TiN(O) (0.2) | — | 1250 |
| | 8 | h' | TiC (0.5) | 1-TiCN (2) | TiCO (0.4) | κ-$Al_2O_3$(7) (1) | TiOw(6) (0.1) | TiN(O) (0.2) | — | 1600 |

TABLE 19

| Drill | | Substrate | Hard coating layer (Figure in parenthesis means designed thickness; μm) | | | | | | Number |
|---|---|---|---|---|---|---|---|---|---|
| | | | First layer | Second layer | Third layer | Forth layer | Fifth layer | Sixth layer | of holes |
| Conventional | 1 | a' | TiCN (0.2) | 1-TiCN (2) | α-$Al_2O_3$(1) (2) | TiN (0.2) | — | — | 800 |
| | 2 | b' | TiN (0.1) | TiCN (1) | TiC (1.5) | TiCO (0.3) | α-$Al_2O_3$(2) (2) | TiN (0.3) | 750 |
| | 3 | c' | TiN (0.5) | 1-TiCN (2) | TiCNO (0.5) | α-$Al_2O_3$(3) (1) | TiN (0.1) | — | 800 |
| | 4 | d' | TiC (0.5) | TiC (2) | TiCNO (0.5) | κ-$Al_2O_3$(6) (1) | TiN (0.2) | — | 600 |
| | 5 | e' | TiN (0.5) | 1-TiCN (2) | TiC (1) | TiCNO (0.3) | α-$Al_2O_3$(2) (2) | TiN (0.5) | 900 |
| | 6 | f' | TiN (1) | TiCN (1) | TiN (1) | TiCNO (0.5) | κ-$Al_2O_3$(6) (2) | TiN (0.05) | 650 |
| | 7 | g' | TiN (0.5) | TiC (2) | α-$Al_2O_3$(4) (2) | TiCN (1) | TiN (0.2) | — | 650 |
| | 8 | h' | TiC (0.5) | 1-TiCN (2) | TiCO (0.4) | κ-$Al_2O_3$(7) (1) | TiN (0.2) | — | 850 |

The disclosures of Japanese priority Applications Nos. H11-104941 filed Apr. 13, 1999; H11-176146 filed Jun. 23, 1999; H11-187780 filed Jul. 1, 1999; H11-228307 filed Aug. 12, 1999; H11-228305 filed Aug. 12, 1999; H11-229301 filed Aug. 13, 1999; H11-229302 filed Aug. 13, 1999; H11-293093 filed Oct. 15, 1999; H11-363925 filed Dec. 22, 1999; H11-363922 filed Dec. 22, 1999; 2000-042178 filed Feb. 1, 2000 and 2000-042181 filed Feb. 1, 2000 are hereby incorporated by reference into the present application.

4. The article of claim 1, wherein said hard coating layer has a thickness of 3 to 30 μm.

5. The article of claim 1, wherein said outermost layer comprises titanium oxide having the molecular formula $TiO_w$ , wherein w is the atomic ratio of oxygen to titanium which ranges from 1.45 to 1.80.

6. The article of claim 5, wherein said outermost layer has a thickness of 0.1 to 3 μm.

7. The article of claim 5, wherein said outermost layer thickness ranges from 0.2 to 1.5 μm.

8. The article of claim 5, wherein said hard coating layer has a thickness of 3 to 30 $\mu$m.

9. A coated cemented carbide cutting member for a cutting tool comprising a substrate and a hard coating layer on said substrate, wherein said hard coating layer comprises at least one layer selected from the group consisting of titanium carbide, titanium nitride, titanium cabonitride, titanium carboxide, titanium carbonitroxide, aluminum oxide, and aluminum oxide-ziconium oxide composite in which zirconium oxide phases are dispersed around ground aluminum oxide phases, wherein said coating layer is provided with a penultimate outermost layer which comprises titanium oxide which is expressed by the molecular formula $TiO_w$, wherein w is the atomic ratio of oxygen to titanium which ranges from 1.20 to 1.90, and wherein said coating layer is provided with an outermost layer on said titanium oxide layer, said outermost layer comprising TiN, TiC or TiCN.

10. The article of claim 9, wherein said outermost layer has a thickness of 0.05 to 2 $\mu$m.

11. The article of claim 9, wherein said outermost layer has a thickness of 0.1 to 1 $\mu$m.

12. The article of claim 9, wherein said penultimate outermost layer has a thickness of 0.1 to 3 $\mu$m.

13. The article of claim 9, wherein said penultimate outermost layer thickness ranges from 0.2 to 1.5 $\mu$m.

14. The article of claim 9, wherein said hard coating layer has a thickness of 3 to 30 $\mu$m.

15. The article of claim 9, wherein said penultimate outermost layer comprises titanium oxide having the molecular formula $TiO_w$, wherein w is the atomic ratio of oxygen to titanium which ranges from 1.35 to 1.70.

16. The article of claim 15, wherein said penultimate outermost layer has a thickness of 0.1 to 3 $\mu$m.

17. The article of claim 15, wherein said penultimate outermost layer thickness ranges form 0.2 to 1.5 $\mu$m.

18. The article of claim 15, wherein said hard coating layer has a thickness of 3 to 30 $\mu$m.

19. The article of claim 9, wherein said outermost layer comprises TiN.

20. The article of claim 19, wherein said outer most layer comprises TiN of the molecular formular $TiN_{1-y}(O)_y$, wherein (O) is diffused oxygen from beneath the titanium oxide layer, and y is the atomic ratio of oxygen to titanium which ranges from 0.01 to 0.40.

* * * * *